United States Patent [19]

Aizawa et al.

[11] 4,238,646

[45] Dec. 9, 1980

[54] PICKUP CARTRIDGE FOR REPRODUCING SIGNALS RECORDED ON A 45—45 STEREOPHONIC RECORD DISK

[75] Inventors: Kenshiro Aizawa; Hisashi Okada, both of Hamamatsu, Japan

[73] Assignee: Nippon Gakki Seizo Kabushiki Kaisha, Hamamatsu, Japan

[21] Appl. No.: 931,728

[22] Filed: Aug. 7, 1978

[30] Foreign Application Priority Data

| | | | |
|---|---|---|---|
| Aug. 10, 1977 | [JP] | Japan | 52-106790[U] |
| Aug. 12, 1977 | [JP] | Japan | 52-107865[U] |
| Dec. 23, 1977 | [JP] | Japan | 52-173676[U] |
| Jan. 7, 1978 | [JP] | Japan | 53-651[U] |

[51] Int. Cl.[3] ..... H04R 9/16

[52] U.S. Cl. ..... 179/100.41 D; 179/100.41 K

[58] Field of Search ..... 179/100.41 D, 100.41 Z, 179/100.41 K; 274/37

[56] References Cited

U.S. PATENT DOCUMENTS

| | | | |
|---|---|---|---|
| 3,207,857 | 9/1965 | Povtot | 179/100.41 K |
| 3,230,318 | 1/1966 | Engel | 179/100.41 K |
| 4,090,039 | 5/1978 | Mori | 179/100.41 D |
| 4,124,783 | 11/1978 | Nemoto | 179/100.41 D |

FOREIGN PATENT DOCUMENTS

| | | | |
|---|---|---|---|
| 1241633 | 6/1967 | Fed. Rep. of Germany | 179/100.41 K |
| 1447982 | 12/1968 | Fed. Rep. of Germany | 179/100.41 K |
| 2020903 | 11/1971 | Fed. Rep. of Germany | 179/100.41 K |
| 2555846 | 7/1976 | Fed. Rep. of Germany | 179/100.41 D |

*Primary Examiner*—Bernard Konick
*Assistant Examiner*—Alan Faber
*Attorney, Agent, or Firm*—Cushman, Darby & Cushman

[57] ABSTRACT

In a pickup cartridge of moving-coil type, the components of movement of a cantilever in the vertical and horizontal directions are individually detected to produce two kinds of electromotive forces respectively proportional to the velocity of the detected vertical and horizontal components of movement. The sum and difference signals of the two kinds of electromotive forces are separately obtained for stereophonic reproduction of signals recorded on a recorded disk. The vibration system is given different vibration characteristics for vertical movements thereof than those for horizontal movements thereof, without sacrificing electrical output characteristics such as channel separation characteristic and low frequency response characteristic.

17 Claims, 27 Drawing Figures

PICKUP CARTRIDGE FOR REPRODUCING SIGNALS RECORDED ON A 45—45 STEREOPHONIC RECORD DISK

BACKGROUND OF THE INVENTION (a) Field of the invention

The present invention is related to pickup cartridges for use in record playback system to reproduce signals recorded on a record disk, and more particularly to stereophonic pickup cartridges of moving-coil type and moving-magnet type.

(b) Description of the prior art

In a 45—45 stereophonic record disk, as well known, left- and right-channel signals are separately recorded or carved on the surfaces of the individual walls which constitute a groove of a record disk. These wall surfaces are inclined symmetrically at an angle of 45 degrees relative to the surface of the disk, and face each other at right angle. The recorded signal waveshapes carried on these wall surfaces can be reproduced in a pickup cartridge by first detecting these signal waveshapes by means of a vibration system, which may include a stylus tip secured on a cantilever for tracing the record groove, and an armature which vibrates jointly with the cantilever within a magnetic field, and then by converting the movements of the vibration system to electrical signals by means of a displacement-electromagnetism conversion system including the armature and coils.

In a conventional known stereophonic pickup cartridges of the moving-coil type and the moving-magnet type, the displacement-electromagnetism conversion system is designed so that the component of movement of the vibration system in a direction perpendicular to one of the wall surfaces of the record groove is directly converted to an electrical signal to provide a reproduced left-channel signal, and that the component of movement of the vibration system in a direction perpendicular to the other one of the wall surfaces of the record groove is directly converted to an electrical signal to provide a reproduced right-channel signal. In a pickup cartridge having a conversion system of the aforesaid arrangement the reproduction of signals with good channel separation requires a high balance between right- and left-channels in such respects as vibration characteristics of the vibration system and conversion efficiency of the movement-electromagnetism conversion system.

On the other hand, the movement of the vibration system in a pickup cartridge tends to be placed under an influence of several factors such as (a) extraneous vibration, (b) the weight of the cartridge and (c) unnecessary vibration at very low frequency due to warping of a record disk used. The extent of influence of these factors upon the movement of the vibration system is dependent on the directions of components of movement of the vibration system. Namely, the weight of the cartridge will affect mainly the component of movement of the vibration system in vertical direction. Vibrations due to warping of the record disk also contribute to the above-said influence upon the component of movement of the vibration system in a vertical direction. For the foregoing reasons, the vibration system is required to possess a vibration characteristic for its vertical component of movement which is different from that for horizontal component of movement. For example, it might be preferable to set larger the stiffness of the vibration system which acts only for the vertical component of movement of this system than for the horizontal component of movement for the purpose of decreasing such ill influence due to warping of the record disk. According to the aforementioned arrangement of the known pickup cartridge, however, it has been very hard to satisfy the requirement for imparting different vibration characteristics for vertical and horizontal movements without the accompanying of degradation of channel separation and other electrical output characteristics. This problem of satisfying the above-said requirement without degradation of channel separation might be considered to be overcome by increasing the stiffness for the horizontal component of movement in accordance with an increase in stiffness for the vertical component of movement and vice versa. If so arranged, however, the sensitivity of the cartridge for reproducing signals of a low frequency range will become decreased, leading to a poor frequency response characteristic, since the low frequency components of the recorded signals are picked up mainly by following the horizontal component of movement of the vibration system.

So far as a pickup cartridge of the variable-reluctance type is concerned, its movement-electromagnetism conversion system is designed so that the component of movement of the vibration system in each of the vertical and horizontal directions is individually detected. Therefore, it may be possible to impart such vibration characteristics of the vibration system as are different between vertical and horizontal movements thereof. However, this known pickup cartridge of the variable-reluctance type has disadvantages including relatively complicated arrangement, poor stability of operation, and large effective mass of the vibration system measured at the stylus tip. Further, it is disadvantageous in that the arrangement for detecting the vertical movement is much different from that for detecting the horizontal movement, which will be an obstacle to attain a high channel separation characteristic.

Further discussion of a known pickup cartridge of the moving-coil type will be made hereunder. In almost all of the ones of this type of cartridge, the moving coils are designed to make circular movements, cutting magnetic fields obliquely, and a relatively large number of parts such as coils per se, a supporting member for these coils and a damping member for damping the vibrations of the vibration system are located in a relatively wide air gap where a magnetic field is established. Thus, it is hard to produce a sufficient intensity of the electromotive force in the coils. Accordingly, in such known pickup cartridge of the moving coil type, the possible efficiency of movement-electromagnetism conversion is limited to a relatively low level.

SUMMARY OF THE INVENTION

It is, therefore, a primary object of the present invention to provide a stereophonic pickup cartridge of moving-coil type and moving-magnet type, in which the components of movement in the vibration system in the vertical and horizontal directions are separately detected.

Another object of the present invention is to provide a stereophonic pickup cartridge of the type described, in which the vibrations in the vibration system can be converted to electrical signals with a high conversion efficiency.

Still another object of the invention is to provide a stereophonic pickup cartridge of the type described, which is capable of reproducing separately the left- and right-channel signals recorded on a record disk with a good channel separation.

A further object of the present invention is to provide a stereophonic pickup cartridge of the type described, in which the vibration system is given different vibration characteristics for vertical movements thereof than those for horizontal movements thereof, without sacrificing electrical output characteristics such as channel separation characteristic and low frequency response characteristic.

These and other objects, advantages and features of the present invention will become apparent by reading the following detailed description of the preferred embodiments when taken in conjunction with the accompanying drawings.

DETAILED DESCRIPTION OF THE PREFERRED EMBODIMENTS

Prior to making description of the embodiments of the present invention, known pickup cartridges of the prior art are first discussed.

Figure 1:
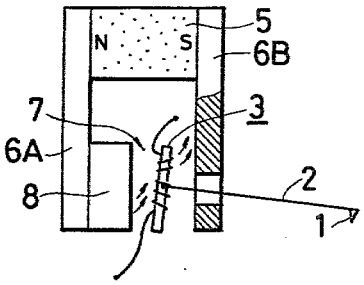
FIG. 1 PRIOR ART
FIG. 1 is a diagrammatic side elevation of a prior art pickup cartridge of the moving-coil type.
Figure 2:
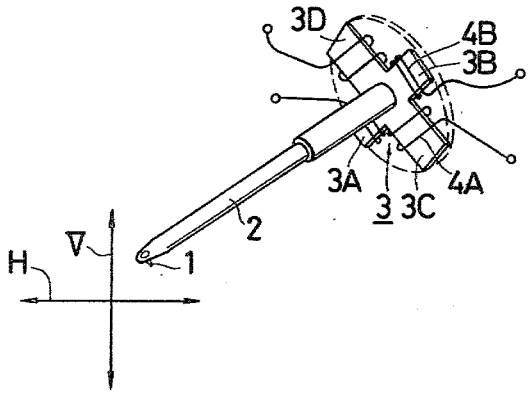
FIG. 2 PRIOR ART
FIG. 2 is a perspective view of the vibration system of the cartridge of FIG. 1.

In FIGS. 1 and 2 there is shown a pickup cartridge of the moving-coil type according to the prior art, which includes a permanent magnet 5, yokes 6A and 6B magnetically coupled to the opposite poles of the magnet 5, and a pole piece 8 provided on the yoke 6A for forming an air (magnetic) gap 7 between the pole piece 8 and the yoke 6B. These members constitute a closed magnetic circuit system involving the air gap 7. The pickup cartridge further includes a vibration system comprising a cantilever 2, a stylus tip 1 secured on the foremost end of the cantilever 2, an armature 3 provided on the base end of the cantilever 2, a supporting member (not shown) for swingably supporting the vibration system and a damping means (not shown) for damping the vibration of the vibration system. The vibration system is supported by said means in such a manner that the cantilever 2 is free to vibrate about a vibration center point generally located at the center of the armature 3, and that the armature 3 is caused to vibrate jointly with the cantilever 2 in a magnetic field established within the air gap 7. The armature 3, as shown clearly in FIG. 2, is comprised of a magnetic material member of a crisscross shape with a first pair of projections 3A and 3B and a second pair of projections 3C and 3D. Each of the projections 3A to 3D is slanted clockwise or counter-clockwise by 45 degrees relative to the vertical as well as the horizontal directions, indicated at V and H, with the first and second pairs being perpendicular to each other. A right-channel moving coil 4A and a left-channel moving coil 4B are wound around the first and second pairs of projections of the armature, respectively.

When the stylus 1 traces the groove of a record disk, the vibration system vibrates according to left- and right-channel signal waveshapes recorded on the opposing walls constituting the record groove. In the right-channel moving coil 4A there is induced an electromotive force corresponding to the component of movement of the vibration system in a direction perpendicular to one wall of the record groove, while, in the left-channel moving coil 4B, there is generated an electromotive force corresponding to the component of movement of the vibration system in a direction perpendicular to the other wall of the record groove. Thus, the right- and left-channel signals recorded on the record disk are separately reproduced in the moving coils 4A and 4B, respectively.

As such, in the pickup cartridge described above, the left- and right-channel signals recorded on a record disk are directly picked up by following the component of movement of the vibration system in directions which are at right angle relative to the respective groove-constituting walls of the record disk. Each of these detected components of movement apparently is either the sum of or the difference between the vertical and horizontal components of movement of the vibration system. Accordingly, it is very hard to impart such vibration characteristics as are different between vertical and horizontal components of movement of the vibration system.

Figure 3:
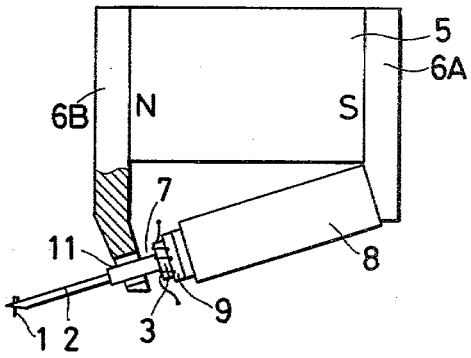
FIG. 3 PRIOR ART
FIG. 3 is a diagrammatic side elevation of another prior art pickup cartridge of the moving-coil type.

FIG. 3 shows a more practical arrangement of such a prior art pickup cartridge as illustrated in FIGS. 1 and 2, in which the pole piece 8 is shaped into a columnar configuration and is inclined downwardly at an angle. The cantilever 2 is pulled, jointly with the armature 3, toward the foremost end of the pole piece 8 by a suspension wire (not shown) and is supported on the pole piece 8 via a damper member 9 interposed between the armature 3 and the pole piece 8. The structure of the armature 3 per se may be the same as that shown in FIG. 2.

In the pickup cartridges as explained previously, the armature is designed to make circular movements in a magnetic field established in the air gap. Thus, the armature requires a relatively large width of air gap for allowing movements thereof. Accordingly, the wide air gap, in turn, makes difficult the establishment of a high intensity of magnetic field in the air gap. Further, it is impossible to keep the direction of movement of the coils just at a right angle relative to the direction of the magnetic field in the air gap. As a result, the efficiency of converting the movement of the vibration system to electrical signals is limited to a relatively low level.

Figure 4:
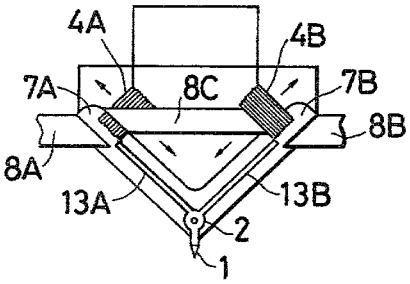
FIG. 4 PRIOR ART
FIG. 4 is a diagrammatic front elevation of a further pickup cartridge of the moving-coil type according to the prior art.

FIG. 4 shows a known pickup cartridge of the moving-coil type, in which the moving coils are designed to move linearly in the air gaps. More particularly, the right- and left-channel moving coils 4A and 4B are mounted on links 13A and 13B extending upwardly from the cantilever 2 at an angle of 45 degrees. In individual air gaps 7A and 7B between a center pole piece 8C and side pole pieces 8A and 8B, the moving coils 4A and 4B are moved linearly, in accordance with the vibration of the cantilever 2, in the directions indicated by arrows in the Figure.

This version of art is advantageous in attaining a higher conversion efficiency, but is disadvantageous in such respects as complexity in construction and weak mechanical coupling between the moving coils and the cantilever. The latter disadvantage in turn leads to an increase in the tendency of occurence of partial resonance of the vibration system and to a decrease in structual strength against external shocks.

Apart from the above-mentioned types of pickup cartridges having a displacement-electromagnetism conversion system designed so that the components of movement of the vibration system are oriented in directions perpendicular to the respective wall surfaces of the record groove, there is a known pickup cartridge of the variable-reluctance type.

Figure 5:
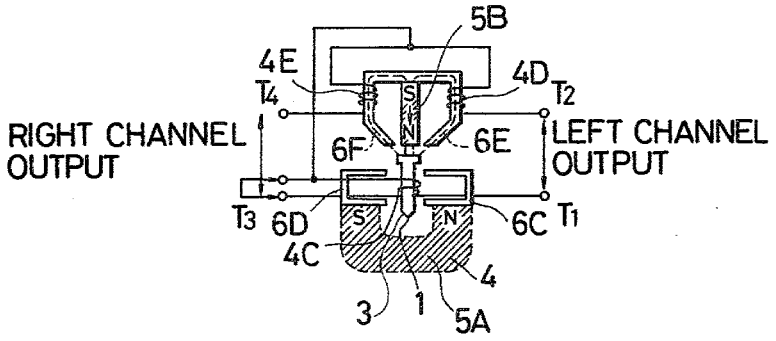
FIG. 5 PRIOR ART
FIG. 5 is a diagrammatic front elevation of a pickup cartridge of the variable reluctance type according to the prior art.

In FIG. 5, a known pickup cartridge of the variable-reluctance type is shown in diagrammatic front elevation, in which vertical and horizontal components of movements of the vibration system are separately detected. This pickup cartridge includes a first magnetic circuit system composed of a magnet 5A and yokes 6C and 6D spaced by an air gap, and a second magnetic circuit system composed of a magnet 5B and yokes 6E and 6F spaced by air gaps. An armature 3 of magnetic material extends vertically through the air gap between the yokes 6C and 6D, with the top end of the armature 3 facing the foremost ends of the magnet 5B and yokes 6E and 6F, and is so supported as to make a swinging movement around the top end thereof in the horizontal direction and a translational movement in the vertical direction. A coil 4C is provided so as to be stationary within the air gap defined between the yokes 6C and 6D in such a way as to surround the armature 3, and coils 4D and 4E are wound in the opposite directions on the respective yokes 6E and 6F.

When the stylus tip 1 mounted on the armature 3 is tracing the groove of a record disk, the armature 3 is caused to vibrate laterally in a swinging motion and vertically in a translational motion in accordance with the recorded signal waveshapes carried on the surfaces of the record groove walls. The lateral component of movement of the armature is converted to a corresponding electrical signal by the combination of the armature 3, the coil 4C and the first magnetic circuit system, in such a movement-electromagnetism conversion manner as employed in the conventional balanced-armature type pickup cartridge intended for monoaural playback. Whereas, the vertical component of movement of the armature 3 produces a corresponding change in the total flux density in the second magnetic circuit system. That is, the magnetic reluctance of the second magnetic circuit system is varied in accordance with the vertical movement of the armature 3. Since the top end of the armature 3 is prevented by, for instance, a suspension leaf (not shown) from making lateral movement, the magnitude of the changes in the flux density in the yokes 6E and 6F in the second magnetic circuit system are substantially identical. Accordingly, there are induced in the coils 4D and 4E electromotive forces which have the same magnitude proportional to the velocity of movement of the armature in vertical direction but which are opposite in polarity because of the inversed winding directions of the coils. In a 45—45 stereophonic record disk, as described previously, the left-channel signal wave-shape is recorded on one of the wall surfaces of the record groove, and the right-channel signal waveshapes is recorded on the other one of the wall surfaces of the record groove. Hence, the horizontal component of movement of the armature 3 is associated with the sum waveshape of the left- and right-channel signal waveshapes, while the vertical component of movement of the armature 3 is associated with the difference between the left- and right-channel signal waveshapes. Consequently, when the coils 4C, 4D and 4E are connected as shown in FIG. 5, there eventually can be obtained separately the left- and right-channel outputs between terminals T1 and T2 and between terminals T3 and T4, respectively.

This instant pickup cartridge of the prior art permits the vibration system including the armature to be easily given different vibration characteristics for vertical movements thereof than those for horizontal or lateral movements thereof. However, the arrangement of this pickup cartridge is complicated and expensive, and on account of the translational movement of the armature, the effective mass of the vibration system meassured at the stylus tip cannot be prevented from becoming undesirably large. Further, with the instant pickup cartridge it is hard to attain a stable characteristic of channel separation for the reason that the vertical and horizontal movements of the armature are detected in extremely different movement-electromagnetism conversion manners. In order to obviate the aforementioned inconveniences and disadvantages encountered in the known pickup cartridges, there is provided, according to the present invention, a pickup cartridge for reproducing signal waveshapes recorded on the surfaces of the walls which constitute a groove on a 45—45 stereophonic record disk, which comprises:

a vibration system including:

a stylus tip for tracing the groove of said record disk, a cantilever carrying, at its foremost end, said stylus tip for making swinging movements centering about a point in accordance with the signal waveshapes recorded on the groove walls, and a supporting means for supporting said cantilever so as to permit said swinging movements of said cantilever but to prevent movements of said cantilever in the axial direction thereof; and a movement-electromagnetism conversion system responsive said swinging movements of said cantilever for generating an electromotive force proportional to the component of velocity of said swinging movements in a direction perpendicular to the surface of said record disk, and an electromotive force proportional to the component of velocity of said swinging movements in a direction parallel to the surface of said record disk.

Several aspects of the present invention will hereunder be explained by referring to the accompanying drawings.

Figure 6:
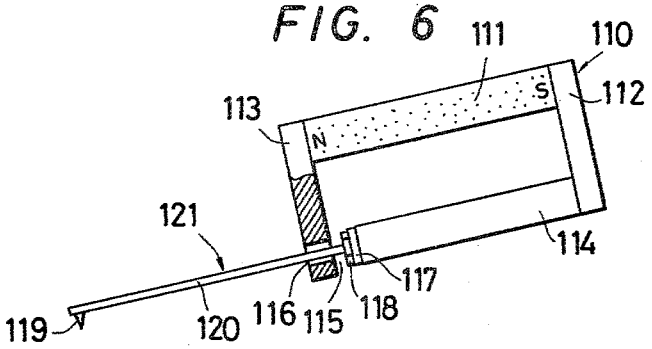
FIG. 6 is a diagrammatic side elevation of a pickup cartridge of the moving-coil type according to an example of the present invention.

FIG. 6 is a schematic side elevation of a moving coil type stereophonic pickup cartridge embodying the present invention, with its housing removed for the convenience of explanation. The device includes a closed magnetic circuit system 110 and a vibration system 121. The magnetic circuit system 110 is composed of a permanent magnet 111 of a bar shape, yokes 112 and 113 of a magnetic material secured to the opposite ends (poles) of the magnet 111, a pole piece 114 of a magnetic material secured, at its base end, to the yoke 112 and extending toward the other yoke 113, and an air gap 115 defined between this yoke 113 and the foremost end of the pole piece 114. The vibration system 121 includes a cantilever 120 having a stylus tip 119 secured to the underside of the foremost end thereof and extending into the air gap 115 through an opening 116 formed in the yoke 113, and an armature 118 fixed to the base end of the cantilever 120, and a damper member 117 interposed between the armature 118 and the foremost end of the pole piece 114. The cantilever 120, at its base end, is pulled toward the pole piece 114 by a suspension wire, e.g. a piano string (not shown) and thus the vibration system 121 is held with respect to the pole piece 114 in such a manner that any displacement of the vibration system 121 in a direction along the axis of the cantilever 120 is prevented but that it is permitted to make swinging movement substantially about the center of the armature 118. The armature 118 may preferably be formed with a magnetic material with a high magnetic permeability, such as Permalloy, Alperm, or Sendust.

Figure 7:
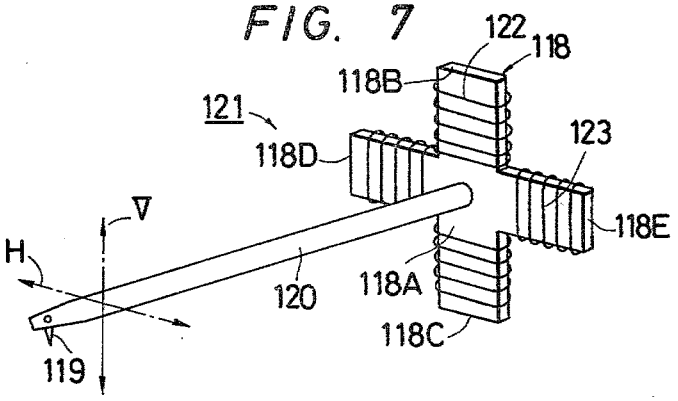
FIG. 7 is a fragmentary perspective view of the vibration system in the cartridge of FIG. 6.

In FIG. 7 is shown an enlarged fragmentary perspective view of the aforementioned vibration system 121. As shown, the armature 118 is generally formed into a crisscross shape and composed of a pair of arm portions 118B and 118C extending divergently from the center portion 118A thereof in the vertical direction indicated by a dashed arrow line V, and another pair of arm portions 118D and 118E extending divergently from the center portion 118A in the horizontal direction indicated by a dashed arrow line H, i.e. in a direction parallel to the record disk surface. Around the arm portions 118B and 118C, one or more conductors 122 are wound to form one or more vertical windings or coils for generating electromotive force proportional to the velocity of vertical movement of the vibrating system 121. Also, one or a plurality of conductors 123 are wound around the arm portions 118D and 118E to form one or plural horizontal windings or coils for inducing electromotive force in proportion to the velocity of horizontal movement of the vibration system 121. These coils constitute, jointly with both the closed magnetic circuit system 110 and the magnetic armature 118, a movement-electromagnetism conversion system which converts vibrations of the vibration system 121 to electrical signals.

Figure 8:
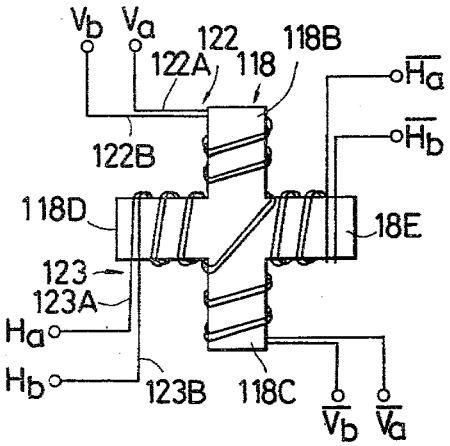
FIG. 8 is a diagrammatic front view for showing an example of arrangement of vertical and horizontal coils on the armature in FIG. 7.

A concrete example of the above vertical and horizontal coils on the armature 118 is shown in FIG. 8. In the Figure, a pair of conductors 122 are wound in the same direction around the arm portions 118B and 118C to form a pair of vertical coils 122A and 122B both having the same number of turns. Similarly, around the arm portions 118D and 118E are wound, in the same direction, another pair of conductors 123 for forming a pair of horizontal coils 123A and 123B, both having the same number of turns.

Figure 9:
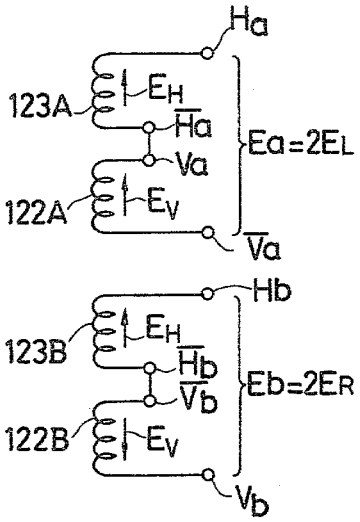
FIG. 9 is an electric circuit diagram for showing an example of wiring between the coils on the armature shown in FIG. 8.

The coils 122A, 122B, 123A and 123B may be used in such mutual connection as is shown in equivalent circuit in FIG. 9, wherein an end Va of the first vertical coil 122A is connected to an end $\overline{Ha}$ of the first horizontal coil 123A, and an end $\overline{Vb}$ of the second vertical coil 122B is connected to an end $\overline{Hb}$ of the second horizontal coil 123B. As will be explained later, left-channel signals recorded on a record disk are regenerated between both open ends Ha and $\overline{Va}$ of the coupled coils 123A and 122A, while right-channel signals recorded on a record disk are reproduced between both open ends Vb and Hb of the coupled coils 122B and 123B. The number of turns of these respective horizontal coils 123A and 123B may preferably be equal to or greater than that of the vertical coils 122A and 122B. When the vibration system 121 makes a movement in a certain direction, the coils 122A–123B are moved jointly with the armature 118 within the magnetic field in the air gap in the closed magnetic circuit system 110. As a result, there are induced voltages Eh in the horizontal coils 123A and 123B, respectively, and also voltages Ev in the vertical coils 122A and 122B, respectively. Both the induced voltages Eh in the horizontal coils 123A and 123B have an intensity proportional to the rate of the vibration system movement in the horizontal direction and a polarity indicated by arrows in the drawing, while both the voltages Ev induced in the vertical windings 122A and 123B have an intensity proportional to the rate of the vibration system movement in the vertical direction and a polarity indicated by arrows.

Suppose now that the above-explained pickup cartridge of the present invention is tracing the groove on a 45—45 stereophonic record disk to reproduce stereophonic signals. In a 45—45 stereophonic record disk, as mentioned previously, left-channel signal waveshapes are recorded on one of the wall surfaces of the record groove at an inclination angle of 45 degrees to the record disk surface, and right-channel signal waveshapes are recorded on the opposing wall surface of the record groove formed at an inclination angle of 45 degrees relative to the record disk surface and making an angle of 90 degrees with respect to the former groove wall. Thus, the vibration system 121 including the armature 118 makes movements or vibrations thereof in accordance with the composite waveshapes of the left- and right-channel signal waveshapes recorded on the respective opposing wall surfaces of the record groove. Accordingly, the amplitudes of vibrations exerted by the vibration system in the horizontal and vertical directions are proportional to the amplitudes of the sum waveshapes of and the difference waveshapes between the left- and right-channel signal waveshapes, respectively. This will, in turn, lead to the fact that there are induced, in the vertical and horizontal coils, voltages Ev and Eh which are substantially equivalent to the difference and sum signals of the recorded left- and right-channel signals, respectively. Namely, the induced voltages Eh and Ev are given, in terms of the recorded left- and right-channel signals $E_L$ and $E_R$, by $$E_H = E_L + E_R \quad (1)$$

$$E_v = E_L - E_R \quad (2).$$

With the connection as shown in FIG. 9, therefore, between the ends Ha and $\overline{\text{V}}$a of the coils 123A and 122A there are delivered out voltages Ea equivalent to the recorded left-channel signals, while between the ends Vb and Hb of the coupled coils 122B and 123B there are delivered out voltages Eb equivalent to the recorded right-channel signals, as follows.

$$\begin{aligned} Ea &= E_H + Ev \\ &= 2E_L \quad (3) \\ Eb &= E_H - Ev \\ &= 2E_R \quad (4). \end{aligned}$$

It should be noted, here, that the required numbers for the horizontal and vertical coils are dependent upon the manner that these coils are mutually connected together for use.

Figure 10:
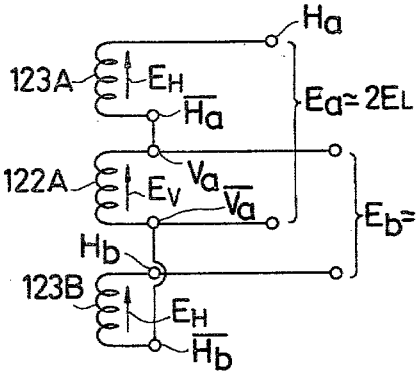
FIGS. 10 and 11 are electric circuit diagrams, respectively, for showing modifications of winding of coils on the armature shown in FIG. 8.

For instance, when a connection as shown in FIG. 10 is applied, one coil 122B among the two vertical coils in FIG. 8 may be eliminated. In this case, the ends Va and $\overline{\text{H}}$a of the coils 122A and 123A are connected together, and the ends $\overline{\text{V}}$a and $\overline{\text{H}}$b of the coils 122A and 123B are jointly coupled together, and thus the left-channel and the right-channel outputs are obtained between the ends Ha and $\overline{\text{V}}$a and between the ends Va and Hb, respectively.

Figure 11:
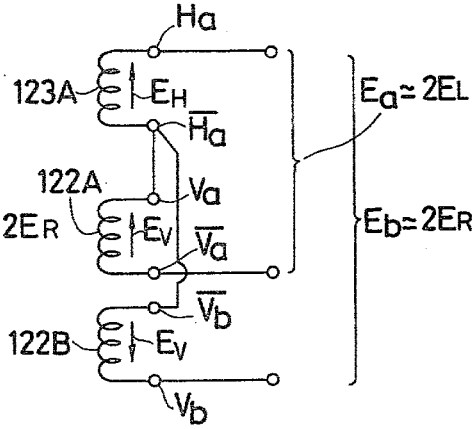

In case, alternatively, such connection as shown in FIG. 11 is applied, one coil 123B among the two horizontal coils may be omitted. In this connection, the end $\overline{\text{H}}$a of the horizontal coil 123A is connected to both the end Va of the vertical coil 122A and the end $\overline{\text{V}}$b of the vertical coil 122B, and hence the left- and right-channel outputs are delivered out between the ends Ha and $\overline{\text{V}}$a and between the ends Ha and Vb, respectively.

Figure 12:
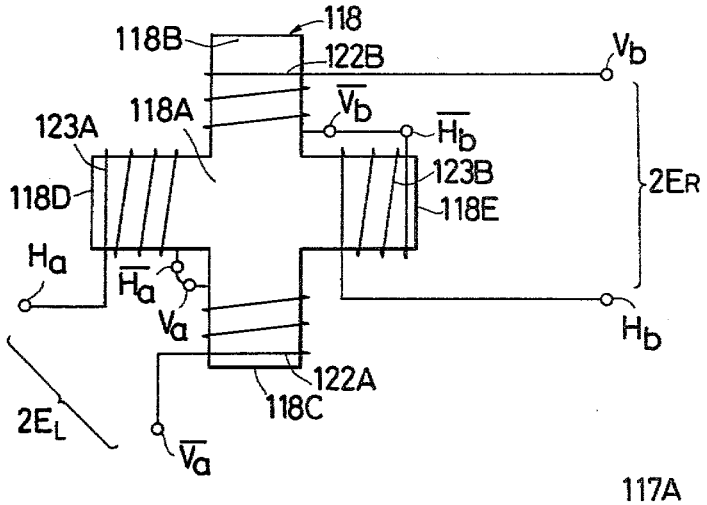
FIG. 12 is a diagrammatic front view for showing another example of arrangement of the coils on the armature in FIG. 7.

Needless to say, each of the vertical and horizontal coils may be separately formed on the individual arm portions 118B through 118E of the armature 118. An example of such modified arrangement for the coils is illustrated in FIG. 12 wherein respective vertical coils 122A and 122B are formed with coils wound around the respective arm portions 118C and 118B, and horizontal coils 123A and 123B are wound separately around the arm portions 118D and 118E, respectively. In this example, the respective coils are mutually connected together in such a manner as shown in FIG. 9. Each pair of coils coupled to each other may be formed integrally with a common continuous conductor. It will be apparent that the arrangement as shown in FIG. 12 has the advantage that no conductor of the coils traverses the center portion 118A of the armature 118, and accordingly such arrangement allows an easy forming procedure of coils and gives no ill effect upon the vibration in the vibration system 121.

Moreover, in the above arrangements, the respective vertical and horizontal coils, if required, may be wound in the opposite directions, respectively, with the connections therebetween, in such case, being adquately modified.

As described above, in the pickup cartridge according to the present invention, the vibrations of the vibration system are detected by both one or more vertical coils assigned exclusively for the detection of the component of movement in the vertical direction and one or more horizontal coils assigned dominantly for detecting the component of movement in the horizontal direction. Therefore, the mechanical characteristics for both the vertical and horizontal vibrations of the vibration system can be optimized easily, at a time, without sacrificing each other and without giving any adverse limitation to the electrical characteristics such as channel separation.

Figure 13:
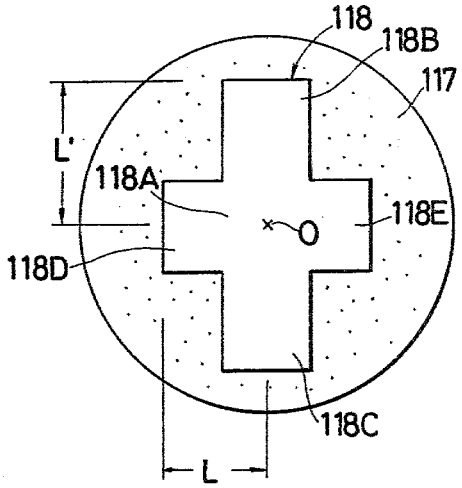
FIG. 13 is a diagrammatic front view for showing an example of damping means for damping the vibrations of the vibration system in FIG. 6.
Figure 14:
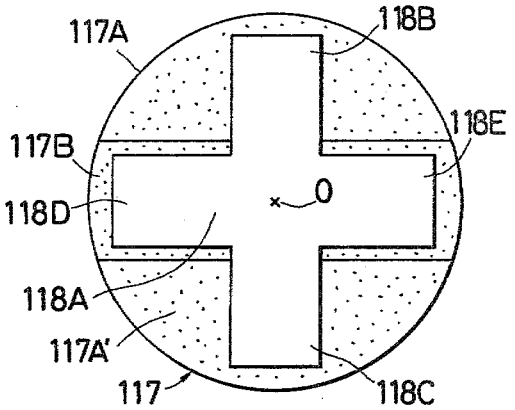
FIGS. 14 and 15 are diagrammatic front elevation and side elevation, respectively, for showing another example of damping means for damping the vibration system in FIG. 6.
Figure 15:
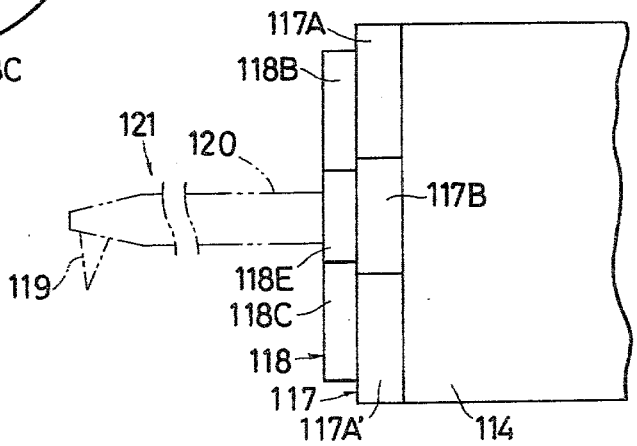

Referring now to FIGS. 13 through 15, descriptions will hereunder be presented for some examples of possible arrangements for simultaneously optimizing the mechanical or vibration characteristics for either vertical movements or horizontal movements of the vibration system of the pickup cartridge of the present invention as shown in FIG. 6.

In FIG. 13, an example of an arrangement of the vibration system is shown, wherein the armature 118 has a pair of vertical arm portions 118B and 118C and a pair of horizontal arm portions 118D and 118E, with the length of arm portions of one pair being different from that of the other pair. More particularly, the distance L from the center O of the armature up to the foremost end of each of the horizontal arms 118D and 118E is set less than the distance L' of each of the vertical arms 118B and 118C. This armature 118 is pulled, jointly with the cantilever (not shown), toward the pole piece (not shown), and brought into contact, over the entire backside surface thereof, with a disk-like damper member 117. This damper 117 is formed with elastic material such as soft rubber having an appropriate flexibility and elasticity, and given a uniform thickness throughout the entire portion thereof so that it will provide a uniform intensity of compliance. As explained, the vibration system including the cantilever (not shown) attached to the armature 118 is designed to swing or vibrate about its vibration center which is substantially at the center O of the armature 118. The movement of the vibration system in the vertical direction is subjected to a further damping effect by the damper 117 than movements in the horizontal direction, because of the difference in longitudinal length between the vertical and horizontal arm portions of the armature. More specifically, the vibration system is given a higher stiffness for vertical movements thereof than for horizontal movements.

FIGS. 14 and 15 show another arrangememt of the vibration system which is given directional vibration characteristics similar to those in the arrangement explained in FIG. 13. In this arrangement, the respective arm portions 118B to 118E have the same length. On the other hand, the damper 117 is modified and composed of a first damper member 117B intervening substantially between the arm portions 118D and 118E of the armature 118 and the foremost end of the pole piece 114, and a pair of second damper member 117A and 117A' interposed between the vertical arm portions 118B and 118C and the end of the pole piece 114. The first damper member 117B is formed with elastic material having a larger compliance than that of the material forming the second damper members 117A and 117A', with all the members having a same thickness.

According to such arrangements of the vibration system as explained with reference to FIGS. 13, 14 and 15, there can be materialized an improved vibration system with the advantage that it is substantially free from undesirable influences given thereon due to warping of the surface of a record disk and the weight of the cartridge.

Figure 16:
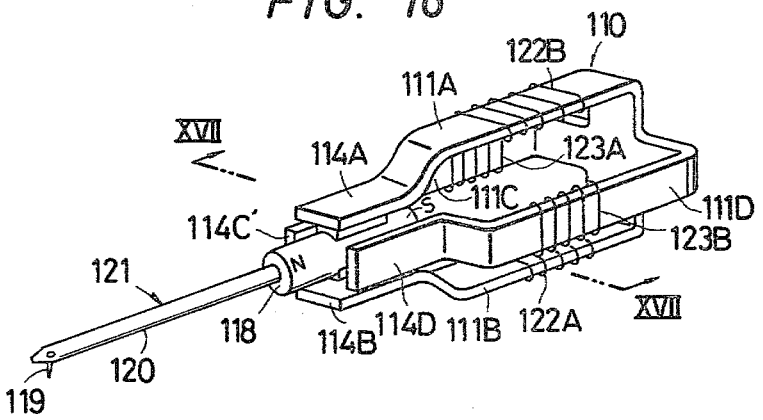
FIG. 16 is a diagrammatic perspective view of a pickup cartridge of the moving-magnet type according to an example of the present invention.
Figure 17:
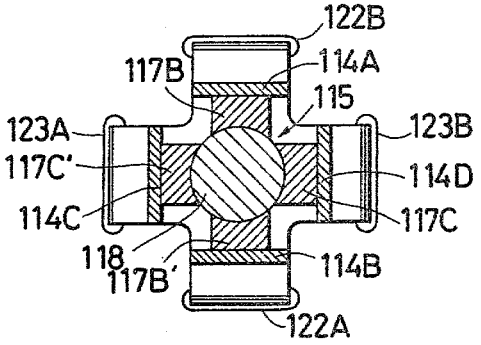
FIG. 17 is a vertical section taken along the line XVII—XVII in FIG. 16.

A moving-magnet-type stereophonic pickup cartridge, with its housing removed, according to the present invention is shown in FIG. 16 in schematic perspective view, and the vertical sectional view taken along line XVII—XVII of FIG. 16 is shown in FIG. 17. In this embodiment, a columnar permanent magnet is used as the armature 118 in the vibration system 121. The yoke in the closed magnetic circuit 110 is integrally formed with four members 111A to 111D arranged at right angles relative to each other, all of which are made with magnetic material having a high magnetic permeability. The foremost end portions of the respective yoke members 111A–111D are slightly bent inwardly to provide pole pieces 114A–114D which constitute vertical and horizontal pairs. The armature 118 is so supported between the respective pole pieces 114A–114D via damper member 117B, 117B', 117C and 117C' that the vibration system 121, which includes the cantilever 120, the armature 118 and the damper members, can swing or vibrate around a specific center of movement of the system but can make no movement in the axial direction of the cantilever 120. All the damper members are formed with elastic material, but one pair of damper members 117B and 117B' are given a less great compliance than that for the other pair of damper members 117C and 117C'. Accordingly, the vibration system 121 is given a larger stiffness for its vertical movements than for horizontal movements. Around the yoke members 111A–111D are wound coils 122A–123B, respectively, which are intended for forming a movement-electromagnetism conversion system jointly with the closed magnetic circuit system 110 and the armature magnet 118.

Vibrations of the vibration system accompanied by displacements of the armature magnet 118 cause variations in the effective distances of individual air gaps defined between the armature magnet 118 poles and the respective pole pieces 114A through 114D, which, in turn, bring about changes in intensity and polarity of the magnetic fluxes in the respective yokes 111A through 111D. Consequently, the vertical coils on the yokes 111A and 111B induce therein electromotive forces proportional to the velocity of movement of the vibration system in the vertical direction, respectively, while there are induced in the horizontal coils on the yokes 111C and 111D electromotive forces proportional to the velocity of movement of the vibration system in the horizontal direction. The vertical coils 122A and 122B and the horizontal coils 123A and 123B are connected in such a fashion as shown in FIG. 9 so that there are reproduced separately left- and right-channel signals.

To this instant embodiment, needless to say, can be applied those modifications concerning the number of the movement detecting coils and the connection therebetween which have been discussed in conjunction with FIGS. 10 and 11.

Referring to FIGS. 18 to 22, another example of the moving-coil-type stereophonic pickup cartridge according to the present invention will be explained.

Figure 18:
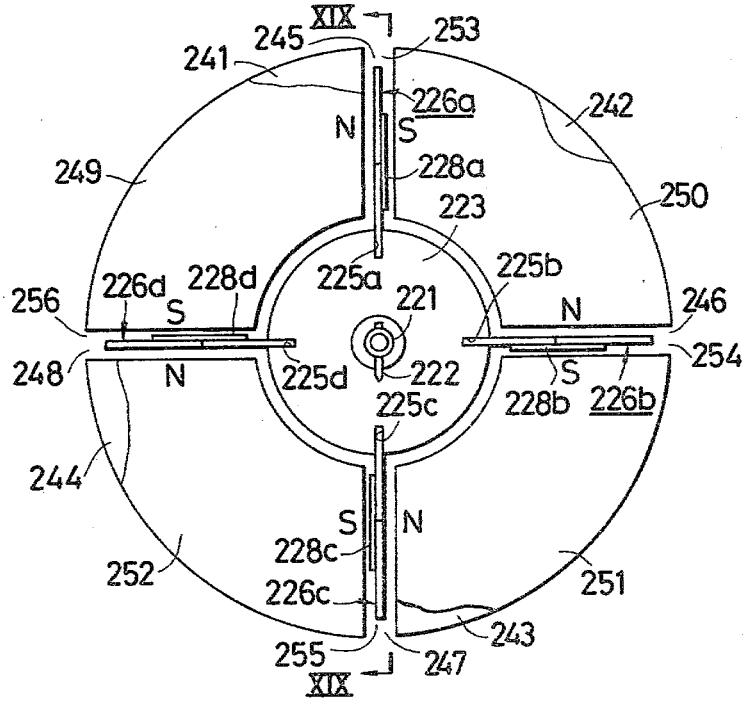
FIG. 18 is a diagrammtic front elevation of a pickup cartridge of the moving-coil type according to another example of the present invention.
Figure 19:
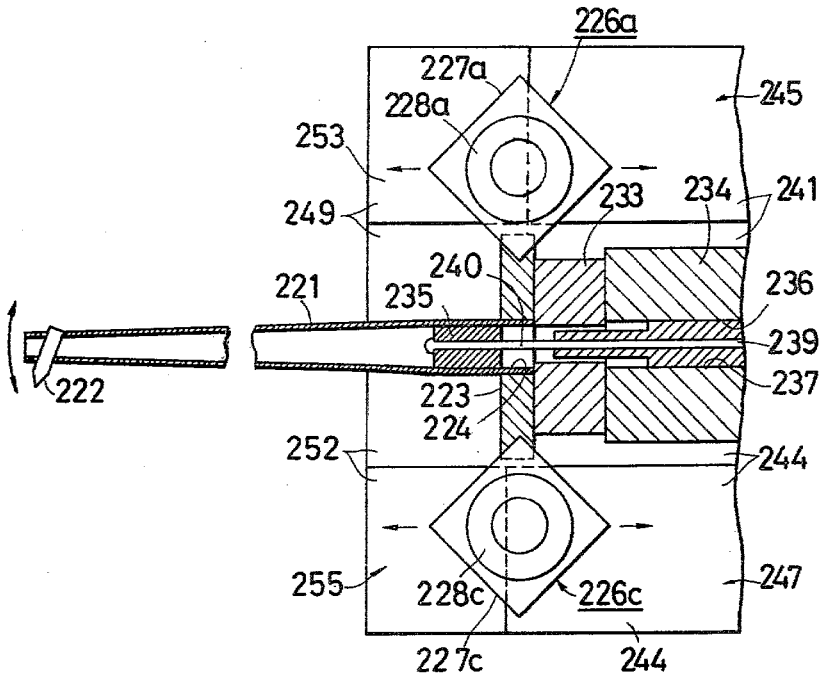
FIG. 19 is a vertical section taken along the line XIX—XIX in FIG. 18.

FIG. 18 shows a front elevation of the embodiment with its housing removed, and the vertical sectional view taken along the line XIX—XIX is shown in FIG. 19. In these Figures, numeral 221 represents a tubular cantilever which is provided with a stylus tip 222 secured to the foremost and thereof. To the base end of the cantilever 221 is attached a coil supporting member 223 of a thin disk shape, which is formed with non-magnetic material such as plastics. The base end of the cantilever 221 extends within a hole 224 formed in the member 223 at the center thereof so that they are secured to each other. In the peripheral portion of the coil supporting member 223 are formed two pairs of cuts **225*a* to 225*d*. The first pair of cuts 225*a* and 225*c* are located on a vertical line intersecting perpendicularly the axis of the cantilever 221, and are arranged symmetrically relative to this axis. On the other hand, the second pair of cuts 225*b* and 225*d* are arranged on a horizontal line crossing perpendicularly the cantilever axis and are symmetrical relative to the axis. A pair of vertical coil units 226*a* and 226*c* and a pair of horizontal coil units 226*b* and 226*d* are received, respectively, in the vertical cuts 225*a* and 225*c* and the horizontal cuts 225*b* and 225*d*, thereby being securely attached to the coil supporting member 223. As clearly seen in FIGS. 18 and 19, the vertical coil units 226*a* and 226*c* are located in a common vertical plane and are arranged at symmetrical positions relative to to the cantilever 221. Also, the horizontal coil units 226*b* and 226*d* are arranged symmetrically with respect to the cantilever 221 and in a common horizontal plane. The vertical and horizontal coil units are provided with vertical coils 228*a* and 228*c* and horizontal coils 228*b* and 228*d***, respectively.

Figure 20:
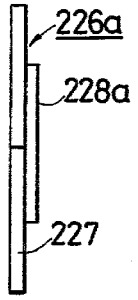
FIG. 20 is a side elevation of the coil unit in the cartridge shown in FIGS. 18 and 19.
Figure 21:
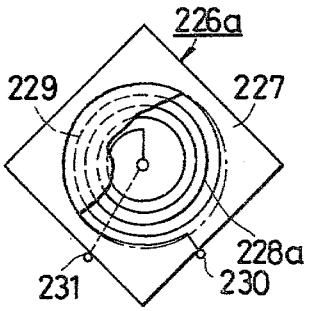
FIG. 21 is a partially sectional front view of the coil unit shown in FIG. 20.
Figure 22:
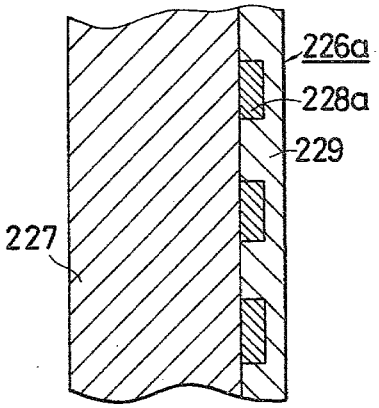
FIG. 22 is a fragmentary enlarged vertical section of the coil unit shown in FIGS. 20 and 21.

In FIGS. 20 to 22, an example of concrete structure of the coil units is shown, wherein the vertical coil units **226*a* is formed with a square-shape thin base member 227, a flat spiral-shape coil 228*a* is deposited on one surface of a base member 227 and an insulating layer 229 covers the coil 228*a*. The base member 227 may be formed with insulator material such as silicone resin. The spiral conductor or coil 228 may be formed with conductor material such as copper and aluminum, by relying on the conventional known techinique, e.g. photo-etching. The insulating layer 229 may be a layer of insulator material such as enamel and polyurethane. The outer end 230 of the coil 228*a* is led along the one surface of the member 227 to the edge of the member, whereas the inner end 231 is led through the member 227 and along the opposite surface of the member to the edge. The other coil units 226*b*, 226*c* and 226*d* are similar in structure to the above-mentioned coil unit 226*a***.

Referring again to FIGS. 18 and 19, the cantilever 221 with the coil assembly mounted thereon is supported on the foremost end of a supporting member 234 via a damper member 233 which is a disk-like shape member formed with elastic material such as soft rubber. More particularly, the cantilever 221 is pulled toward the supporting member 234 by a suspension wire 239, e.g. a piano string extending within a center hole 236 of the member 234. One end of the suspension wire 239 is secured to the cantilever 221 base end via a filling member 235 fixed inside the cantilever 221, and the other end is secured to the supporting member 234. Furthermore, the damper member 233 is interposed between the foremost end of the member 234 and the rear side of the coil supporting member 223. As stated, a vibration system is constituted by cantilever 221, stylus tip 222, coil supporting member 223, coil units 226*a* to 226*d*, damper member 233, filling member 235 and suspension wire 239. The vibration system is allowed to make free but damped vibrations centering around its specific vibration center indicated at 240, although being prevented from moving in the axial direction of the cantilever 221.

Around the damper member 233 and the supporting member 234, permanent magnets 241 to 244 are arranged in a circular fashion. The opposite poles of the respective neighboring magnets face each other to define narrow air gaps 245 to 248 therebetween, whereby a uniform magnetic field is established. Ahead of the respective magnets 241 to 244 are arranged members 249 to 252 of nonmagnetic material such as synthetic resin to constitute spaces 253 to 256 therebetween which are continuous to the corresponding air gaps 245 to 248 and may have the same width as the air gap. The coil unit 226*a* is movably positioned within the connected air gap 245 and space 253; the coil unit 226*b*, within the connected air gap 246 and space 254; the coil unit 226*c*, within the connected air gap 247 and space 255; and the coil unit 226*d*, within the connected air gap 248 and space 256. The respective spaces 253 through 256 contain therein damping-action-producing viscous fluid such as silicone oil for applying a damping force to the coil units 226*a* to 226*d*. Because of the narrow width of the spaces 253 to 256, e.g. 0.5 mm, such filled damping fluid material remains in the space due to its own viscosity.

As can be easily understood, in case the stylus tip 222 traces the groove on a record disk, the vertical coil units 228*a* and 228*c* are rendered to make, jointly with the cantilever 221 in the vibration system, practically linear movements, perpendicularly cutting magnetic lines in the air gaps 245 and 247, the velocity of the movements being in proportion to the component of velocity of the cantilever system in the vertical direction. Whereas, the horizontal coil units 226*b* and 226*d* are caused to make substantially linear movements, cutting perpendicularly magnetic fluxes in the air gaps 246 and 248, the velocity of such movements being proportional to the component of velocity of the cantilever in the horizontal direction. Accordingly, there is induced in the vertical coils 228*a* and 228*c* an electromotive force proportional to the component of velocity of the cantilever vibrations in the vertical direction, while in the horizontal coils 228*b* and 228*d*, there is induced an electromotive force proportional to the component of velocity of the cantilever vibration in the horizontal direction.

The respective armature coils 228*a* through 228*d* are used in such mutual connection that, with the polarities of the electromotive forces in the respective coils being taken into consideration, there are obtained separately the sum of the electromotive forces in one horizontal coil and one vertical coil, i.e. the left-channel signal, and the difference in the electromotive forces in the other horizontal and vertical coils, i.e. the right-channel signals, respectively. In other words, the respective armature coils are connected in accordance with the manner shown in FIG. 9 wherein the coils 122A and 122B are equivalent to the vertical coils 228*a* and 228*c*, and the coils 123A and 123B to the horizontal coils 228*b* and 228*d*.

It should be noted, here, that modifications concerning the connection of the armature coils such as those explained referring to FIGS. 10 and 11 may be applied to the instant embodiment cartridge.

According to the instant arrangement, there can be attained those advantages described below, in addition to those attained in the preceding embodiments. Namely, a relatively small number of component parts located in the air gaps permits the width of the gaps to be reduced greatly, causing the density of the magnetic flux produced in these gaps to be increased correspondingly. Furthermore, the coils remain perpendicularly cutting the magnetic fluxes in the air gaps. As a result, it is possible to attain a higher movement electromagnetism conversion efficiency in the armature coils. This will, in turn, enable the forming of a lighter and smaller arrangement of the armature assembly including the coil supporting member 223 and the coil units 226*a* through 226*d* by using a light nommagnetic material, so that it is possible to easily assemble a vibration system which has a reduced effective mass and a higher trackbility.

Additionally speaking, in the embodiment shown in FIGS. 18 and 19, the mechanical vibration characteristics for movements of the vibration system in the vertical direction are easily optimized separately from those in the horizontal direction, and vice versa. Such optimization of the vibration characteristics may be accomplished since the mass of each of the sets of vertical and horizontal coil units is individually set for optimum response the damper member 223 is so arranged as to exert different but optimum strengths of damping action onto vertical and horizontal movements of the vibration system, respectively. As an alternative to the latter means, the viscosity of the damping fluid material filling the spaces 253 and 255 may be different from that in the spaces 254 and 256.

Figure 23:
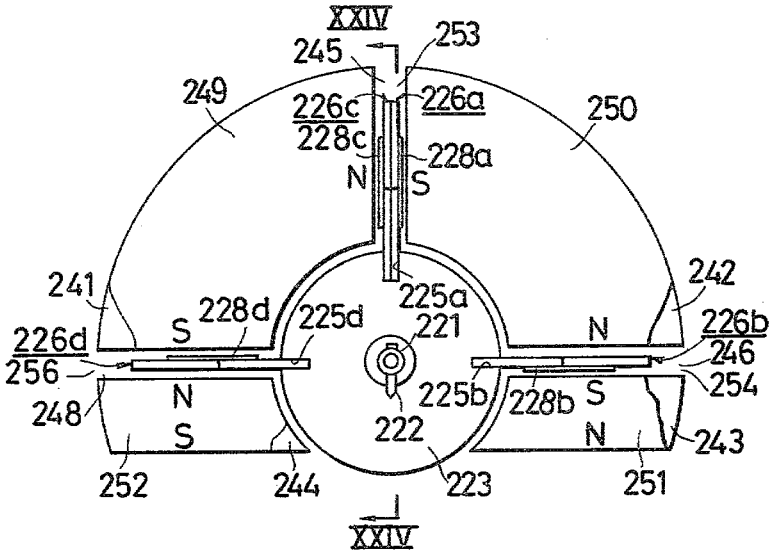
FIG. 23 is a diagrammatic front elevation of a pickup cartridge of the moving-coil type according to still another example of the present invention.
Figure 24:
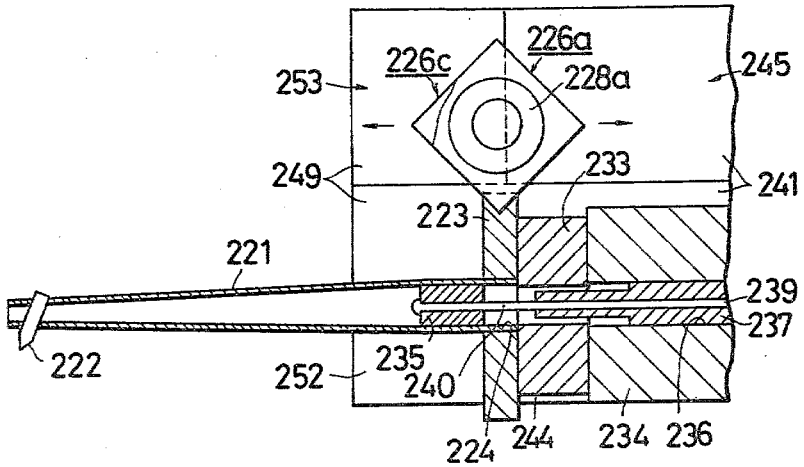
FIG. 24 is a vertical section taken along the line XXIV—XXIV in FIG. 23.
Figure 25:
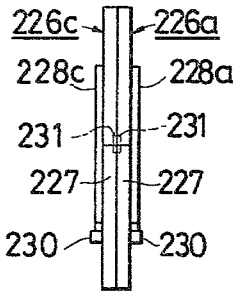
FIG. 25 is a side elevation of the coupled vertical coil units in FIGS. 23 and 24.

In FIGS. 23 and 24 there is shown a modification of the previous embodiment of FIGS. 18 and 19, in which the lower portions of the magnets 243 and 244 and members 251 and 252 are cut away from the purpose of minimizing the distances from the vibration center point 240 to these cutaway bottom surfaces. Furthermore, the vertical coil unit 226*c*, which is located under the cantilever 221 as in the previous embodiment, is changed to be arranged within the air gap 245 and space 253 wherein there is also arranged another vertical coil unit 226*a*. Both the coil units 226*a* and 226*c*, although arranged as explained with respect to FIGS. 20 to 22, are mechanically coupled together, at their bases 227 and 227, in back to back relationships as shown in FIG. 25. Therefore, the coils 228*a* and 228*c* on the coil units 226*a* and 226*c* are mutually inverse in winding direction. The inner ends 231 and 231 of spiral armature coils 228*a* and 228*c* are connected together, while the ends 230 and 230 are led out on the edges of the bases 227 and 227 to form individual terminals of the coupled coils. Thus, the induced voltages in the coils 228*a* and 228*c* are summed up to be delivered between the terminal 230 and 230 of the respective coils 228*a* and 228*c*. The armature coils 228*a* to 228*d* are used in such connection as will produce separately left- and right-channel signals. For instance, the armature coils 228*a* to 228*d* may be connected in such a manner as is shown in FIG. 10 wherein the coil 122A is replaced by the coupled vertical coils 228*a* and 228*c*, and the coils 123A and 123B are equivalent to the horizontal coils 228*b* and 228*d*, respectively.

Additionally speaking, it is possible to establish the numbers of turns of the armature coils so that each of the horizontal coils 228*b* and 228*d* will induce a voltage not smaller than the total voltage induced in the coupled vertical coils 228*a* and 228*c* when the horizontal and vertical coils are moved at the same velocity, cutting the magnetic field in the corresponding air gaps. In the embodiment shown in FIGS. 23 to 25, the vertical coils 228*a* and 228*c* are connected in series to be commonly used in magnetic circuits. However, it should be noted that the vertical coils 228*a* and 228*c* are separately used in separate magnetic circuits wherein the coil 228*a* is connected to one of the horizontal coils 228*b* and 228*d* and the coil 228*c* to the other of them in such a manner as is shown in FIG. 9. It should also be understood that the vertical coil units 226*a* and 226*c* may be formed integrally in a single coil unit 228*a*' as shown in FIG. 26.

Figure 26:
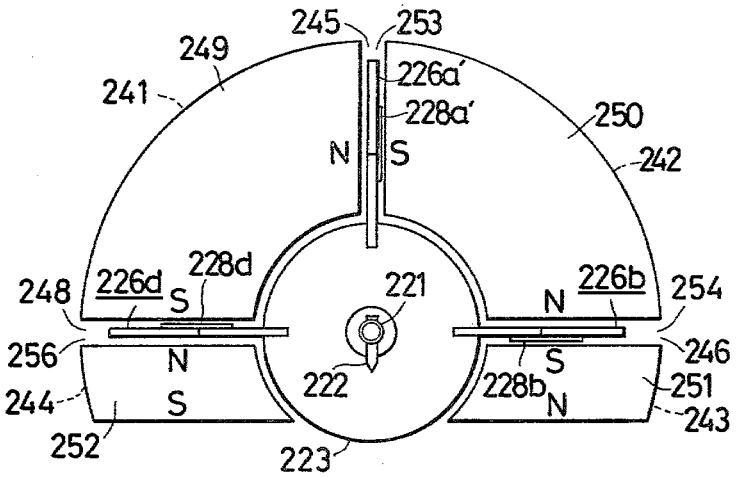
FIG. 26 is a diagrammatic front elevation for showing a modification of the cartridge shown in FIGS. 23–25.
Figure 27:
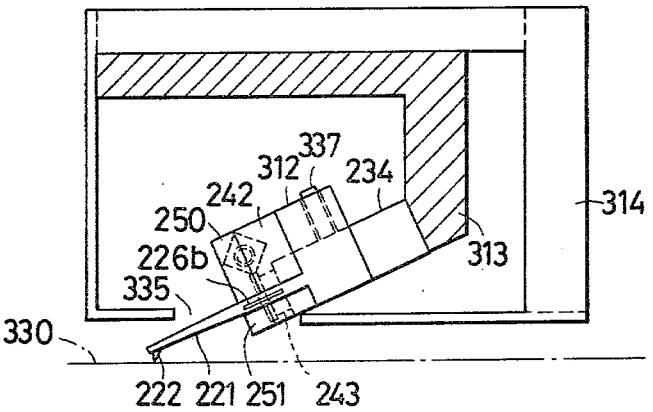
FIG. 27 is a diagrammatic side elevation of the pickup cartridge of FIG. 26 which is assembled in a housing.

The above embodiment of the present invention, which has been explained referring to FIGS. 24 to 26, may be mounted in a cartridge housing as shown in a diagrammatic vertical section in FIG. 27. In the Figure, the supporting member 234 is attached to a mounting frame 313 provided in the housing 314. Numeral 312 represents a member for fixing, jointly with a screw 337, the magnets 241 to 244 on the supporting member 234. The cantilever 221 is positioned to extend outwardly, through an opening 335 formed in bottom wall of the housing 314, at an angle with respect to the surface 330 of a record disk to be played back by the cartridge.

As is apparently from FIG. 27, cutting away the lower portions of both the magnets 243 and 244 and the members 251 and 252 permits easy optimization of the inclination angle of the cantilever 221 relative to the record disk surface, without being accompanied by undesirable limitations as to the length of the cantilever 221, while leaving a sufficient distance between the record disk surface and the lowest parts of the cartridge.

What is claimed is:

1. A pickup cartridge for reproducing signals recorded in the form of undulations of surfaces of walls of a groove formed on a 45—45 stereophonic record disk, comprising:

a vibration system including:

a stylus tip adapted to be moved in accordance with the undulations of the groove walls for tracing the groove of said record disk, a cantilever carrying, at its foremost end, said stylus tip and making swinging movements centering about a point in accordance with a movement of said stylus tip, and supporting means for supporting said cantilever to permit said swinging movements of said cantilever while preventing movement of the cantilever in an axial direction thereof;

means for producing a magnetic field; and a movement-electromagnetism conversion system responsive to the swinging movements of said cantilever within said field, said system including:

first and second coil means, one of said coil means being wound about an axis extending parallel to the record disk and the other of said coil means being wound about an axis extending perpendicular to the record disk;

said first coil means being mechanically coupled to said cantilever for moving together with said cantilever within the magnetic field and being arranged to induce therein an electromotive force proportional to the component of velocity of the movement of said stylus tip in a direction parallel to a surface of said record disk;

said second coil means being mechanically coupled to said cantilever for moving together with said cantilever within the magnetic field and being arranged to induce therein an electromotive force proportional to the component of velocity of the movement of said stylus tip in a direction perpendicular to the surface of said record disk;

means electrically coupling said first and second coil means with one another to deliver the sum of, and the difference between, electromotive forces induced in the first and second coil means; and damping means for damping movements of said cantilever.

2. A pickup cartridge according to claim 1, in which: said first and second coil means include two first and two second coils, respectively; and in which: one of the two first coils and one of the two second coils are mutually coupled together to produce a sum of electromotive forces induced therein, and the other of the two first coils and the other of the two second coils are mutually coupled together to produce a difference in electromotive forces induced therein.

3. A pickup cartridge according to claim 1, in which: said first coil means includes two first coil members; and in which: one of the two first coil members and said second coil means are mutually coupled together to produce a sum of electromotive forces induced therein, and the other of the two first coil members and said second coil means are mutually coupled together to produce a difference in electromotive forces induced therein.

4. A pickup cartridge according to claim 1, in which: said second coil means includes two second coil members; and in which: one of the two second coil members and said first coil means are mutually coupled together to produce a sum of electromotive forces induced therein, and the other of the two second coil members and said first coil means are mutually coupled together to produce a difference in electromotive forces induced therein.

5. A pickup cartridge according to claim 1, in which: said first coil means comprises at least one conductor wound around a first member extending from said cantilever in a direction parallel to the surface of said record disk; and said second coil means comprises at least one conductor wound around a second member extending from said cantilever in a direction perpendicular to said first member.

6. A pickup cartridge according to claim 5, in which: said first and second members are formed with magnetic material.

7. A pickup cartridge according to claim 5, in which: said first and second members are formed integrally in an armature member of a criss-cross shape secured to a base end of said cantilever, and said first and second members cross each other at right angle at their centers on the axial line of said cantilever.

8. A pickup cartridge according to claim 7, in which: said damping means is composed of a damper member made with elastic material and having a uniform compliance over the entire region of the damper member, the damper member being interposed between said armature member and a supporting member; and said supporting means is composed of a suspension wire for pulling the base end of said cantilever toward said supporting member, and in which: said first member is given a length different from that of said second member.

9. A pickup cartridge according to claim 7, in which: said damping means is composed of a first damper member made with elastic material and interposed between said first member of said armature member and a supporting member, and a second damper member made with elastic material and interposed between said second member of said armature member and said supporting member, the second damper member having a compliance different from that of said damper member; and said supporting means is comprised of a suspension wire for pulling the base end of said cantilever toward said supporting member.

10. A pickup cartridge according to claim 1, in which: said first and second coil means are provided on an armature member secured to a base end of said cantilever; said damping means is a damper member made with elastic material and interposed between said armature member and a supporting member; and said supporting means is composed of a suspension wire for pulling the base end of said cantilever toward said supporting member.

11. A pickup cartridge according to claim 10, in which: said magnetic field producing means includes a magnet, at least one yoke made with magnetic material and magnetically coupled to one pole of said magnet, and a pole piece made with magnetic material and magnetically coupled to another pole of said magnet, said pole piece constituting at least a part of said supporting member and defining at least one air gap between said yoke and said pole piece, said magnetic field being produced in said air gap.

12. A pickup cartridge according to claim 1, in which: said second coil means is supported on said cantilever for movement jointly with said cantilever in a first plane perpendicular to the surface of said record disk for inducing therein an electromotive force proportional to the perpendicular movement component of the stylus tip; and said first coil means is supported on said cantilever for movement jointly with said cantilever in a second plane perpendicular to said first plane for inducing therein an electromotive force proportional to the parallel movement component of the stylus tip.

13. A pickup cartridge according to claim 12, in which: said first and second coil means are flat spiral coils oriented to be parallel with said second and first planes, respectively.

14. A pickup cartridge according to claim 13, in which: said magnetic field producing means includes at least one first air gap in which said first coil means is located, and at least one second air gap in which said second coil means is located, said magnetic field being established in said respective air gaps.

15. A pickup cartridge according to claim 14, further comprising: means for forming at least one space in which a part of said first coil means is located, and means for forming at least one second space in which a part of said second coil means is located, and in which: said damping means includes a viscous fluid filling said first and second spaces.

16. A pickup cartridge according to claim 13, in which: each of said first and second coil means includes a base member supported on said cantilever and at least one conductor disposed on the base member.

17. A pickup cartridge according to claim 12, in which: said second coil means is arranged above said cantilever.

* * * * *